United States Patent [19]

Biondetti

[11] 4,036,683

[45] July 19, 1977

[54] WEB PRESS FOR A PAPER MACHINE

[75] Inventor: Mario Biondetti, Schio, Italy

[73] Assignee: Escher Wyss G.m.b.H., Ravensburg, Germany

[21] Appl. No.: 718,084

[22] Filed: Aug. 26, 1976

[30] Foreign Application Priority Data

Aug. 28, 1975 Switzerland ..... 11140/75

[51] Int. Cl.[2] ..... D21F 3/02

[52] U.S. Cl. ..... 162/274; 162/358; 162/360 R

[58] Field of Search ..... 162/273, 274, 199, 358, 162/360 R, 360 DP

[56] References Cited

U.S. PATENT DOCUMENTS 2,360,773 10/1944 Helin ..... 162/273

2,950,224 8/1960 Balough ..... 162/274 X 3,600,273 8/1971 McCarrick et al. ..... 162/273

FOREIGN PATENT DOCUMENTS 2,239,267 3/1973 Germany

*Primary Examiner*—S. Leon Bashore

*Assistant Examiner*—Richard V. Fisher

*Attorney, Agent, or Firm*—Kenyon & Kenyon, Reilly, Carr & Chapin

[57] ABSTRACT

The lower guide roll for the press felt is pivotally mounted at one end to pivot upwardly in order to allow the press felt to be mounted or removed from the press. The bearing at the pivot end is secured on a support which, in turn, is pivotal about a horizontal axis below the bearing.

3 Claims, 3 Drawing Figures

II
24
20
1

24
-10-
1
12
10
22
20
23
21
3
17
25
2
27
18
32
28
26
-3-
7
32
3
8
15
15
31
28
50
33
52
53
33
51
37
30
8
7
36
34
16
35
I

I
12
14
10
1
22
23
12
11
12
2
5
4
25
18
13
6
3
32
15
8
33
33
7
7
8
34
34
16
35
35
I

WEB PRESS FOR A PAPER MACHINE

This invention relates to a web press for a paper machine.

As is known, paper making machines frequently have a web press in which an endless press felt passes between press rolls and over guide rolls, the press felt forming a loop which extends downwardly from the press roll. At least one of the guide rolls is disposed in the loop in the bottom region thereof.

In web presses of this kind, there are difficulties in connection with changing the press felt which in some cases may be very heavy, particularly if the press rolls are situated in the top area of the loop and the loop extends downwardly into a basement area beneath the paper machine where there is very little room available at the side. These difficulties are aggravated in modern felts or felt-wire combinations consisting of synthetic materials which are very stiff.

Accordingly, it is an object of the invention to provide a web press in which replacement of the press felt is greatly simplified.

Briefly, the invention provides a web press for a paper making machine which comprises a plurality of press rolls for pressing an endless press felt and a plurality of guide rolls disposed below the press rolls to guide the press felt in a downwardly directed loop. At least one of the guide rolls is located in the bottom region of the loop and is pivotally mounted about an axis adjacent one end to pivot upwardly from an operative position. This construction allows the bottom guide roll, or a number of guide rolls, to be pivoted so that the press felt can be readily introduced and removed.

Preferably, the pivotal guide roll may be journalled on a bearing which is releaseably secured while the other bearing of the guide roll may be secured to a support which is pivotable about a horizontal pivot axis situated at right angles to the axis of the roll and beneath the bearing. In addition, the support is supported on an abutment element when the guide roll is in an operative position. This greatly simplifies the rocking or pivoting operation while, at the same time, the support allows the guide roll to be swung aside by a greater amount than would be possible without the support.

A lifting means may be provided to lift the pivotal guide roll and includes a cable by means of which the releaseably secured bearing together with the associated roll end can be lifted up. In this way, a simple mechanism is obtained for swinging the rolls aside.

Finally, preferably in a press in which the guide roll is mounted in spherical bearings, an abutment ring encloses the shaft of the guide roll and is associated with each of the guide roll bearings to limit the rocking movement of the bearing with respect to the shaft. In this way, the guide roll can be readily lifted at the releaseably secured bearing without any special precautions and without any fear of damage to the rockable mounting.

These and other objects and advantages of the invention will become more apparent from the following detailed description and appended claims taken in conjunction with the accompanying drawings in which:

Figure 1:
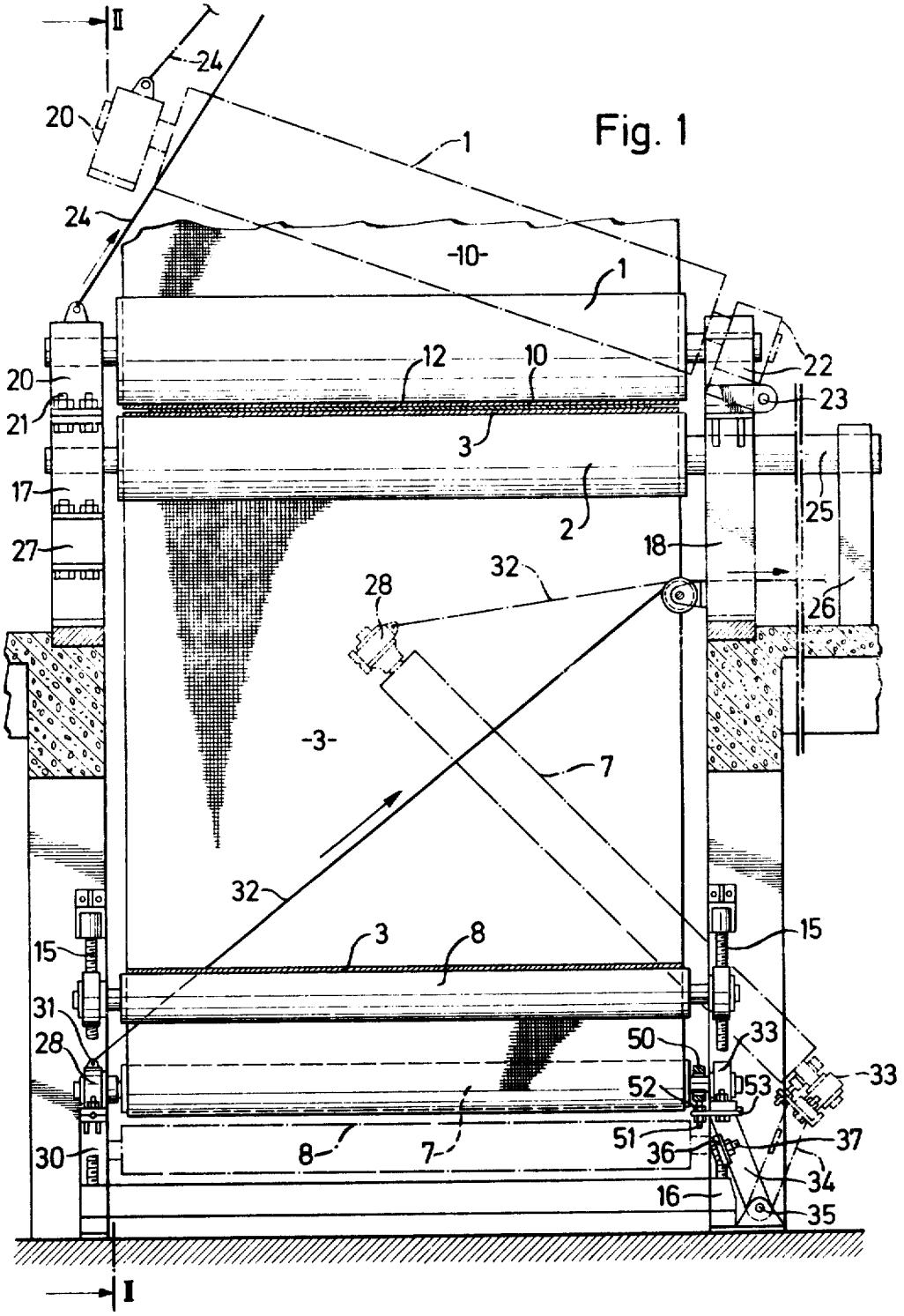
FIG. 1 illustrates a front elevational view of a web press according to the invention as viewed in the longitudinal direction of a paper machine and taken on line I—I of FIG. 2.

Referring to FIG. 1, the web press for a paper making machine comprises press rolls 1, 2 between which a bottom felt 3 passes. In addition, the press has top guide rolls 4, 5, 6, bottom guide rolls 7 and a bottom tensioning roll 8 over which the bottom felt is taken. A top felt 10 is also passed between the press rolls 1, 2 although it is shown only partly in FIG. 2, and passes over a guide roll 11. The top felt 10 acts as a take-off felt to receive a paper web 12 from a wire 13 of the paper machine, only the end of which is shown in FIG. 2.

Figure 2:
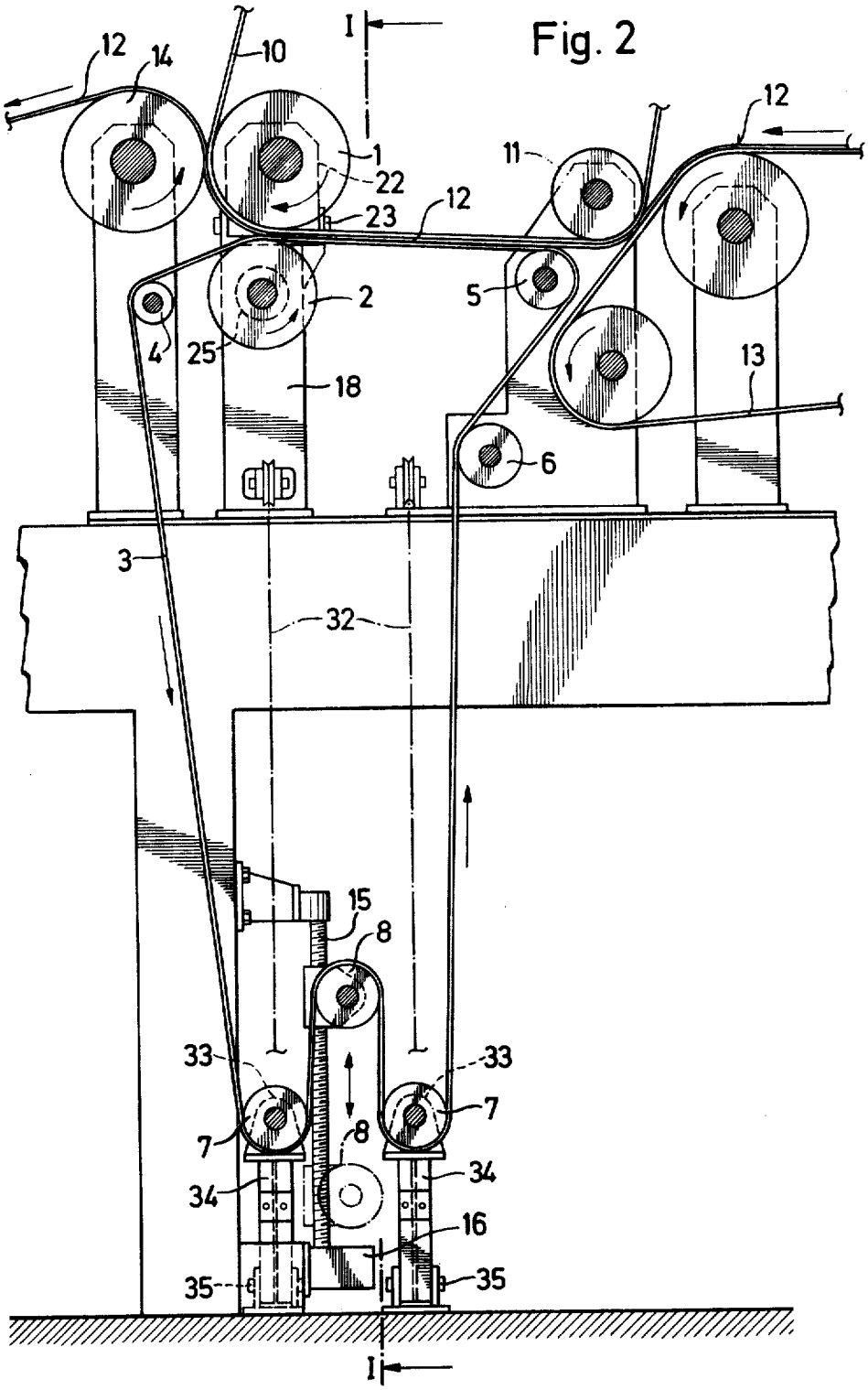
FIG. 2 illustrates a view taken on line II—II of FIG. 1.

As will be apparent from FIG. 2, the paper web 12 is fed to the bottom press felt 3 by means of the take-off felt 10 and passes between the two felts 3, 10 into the nip between the press rolls 1, 2. After pressing between the felts 3 and 10, the paper web 12 is taken off the top felt 10 by a granite roll 14 and fed to a dry end (not shown) of the paper machine.

Referring to FIG. 2, the bottom press felt 3 forms a loop which extends downwards from the press rolls 1, 2, the two guide rolls 7 being disposed in the loop in the bottom region thereof. The tensioning roll 8 is adjustable by means of adjusting screws 15 and drive motors 16 to impart the required tension to the felt 3.

As will be apparent, particularly from FIG. 1, the press rolls 1, 2 are mounted on uprights 17, 18. The left-hand end of the top press roll 1 is provided with a bearing 20 which is releaseably secured to the upright 17 by screws 21. A bearing 22 which is rockable about a pivot 23 is provided at the other end of the top press roll 1.

For introduction or removal of the bottom press felt 3, the top press roll 1 can be lifted by means of a cable 24, after the screws 21, have been released and be moved into the chain-dotted position shown.

In the present example, the bottom press roll 2 is a sag compensating roll which may be constructed, for example, in accordance with Swiss Pat. Nos. 541,088 and 556,946. The advantage of such a roll is that the contact-pressure force is exerted by the support elements situated inside the roll barrel and the roll therefore requires no external contact-pressure mechanism.

As will be seen from FIG. 1, the bottom press roll 2 constructed as a sag compensating roll comprises a central fixed shaft 25 having one end extended to the right, this end being retainable in an additional support 26 for the felt exchange. The additional support 26 allows an intermediate part 27 of the support 17 to be removed so that a gap forms at the place of this intermediate element for introduction of the felt 3.

Referring to FIG. 1, the guide rolls 7, which are situated in the bottom region of the loop of the press felt 3, have bearings 28 at their left-hand ends as viewed. These bearings are releaseably secured to supports 34. The bearings 28 are provided with eyes 31 for a cable 32 of a lifting means not shown in detail, by means of which the end of a guide roll 7 can be lifted. The right-hand end of each roll 7 is mounted by means of a bearing 33 on a support 34 which is pivotable about a pivot 35 having a horizontal axis at right angles to the axis of the roll 7 and situated beneath the roll 7.

In operation, the pivotal supports 34 are supported on a fixed abutment element 36 to which they are connected by screws 37. In order to change the felt 3, the pivotal supports 34 can be swung up and to the right into the chain-dotted position after the screws 37 have been released and after the bearings 28 have been released as already stated. The advantage of rotation about the pivot 35 situated beneath the roll 7 is that when the left-hand end of the roll 7 is lifted together with the bearing 28, the right-hand bearing 33 of the roll 7 is moved aside so that there is more clearance for introduction of the felt 3.

Figure 3:
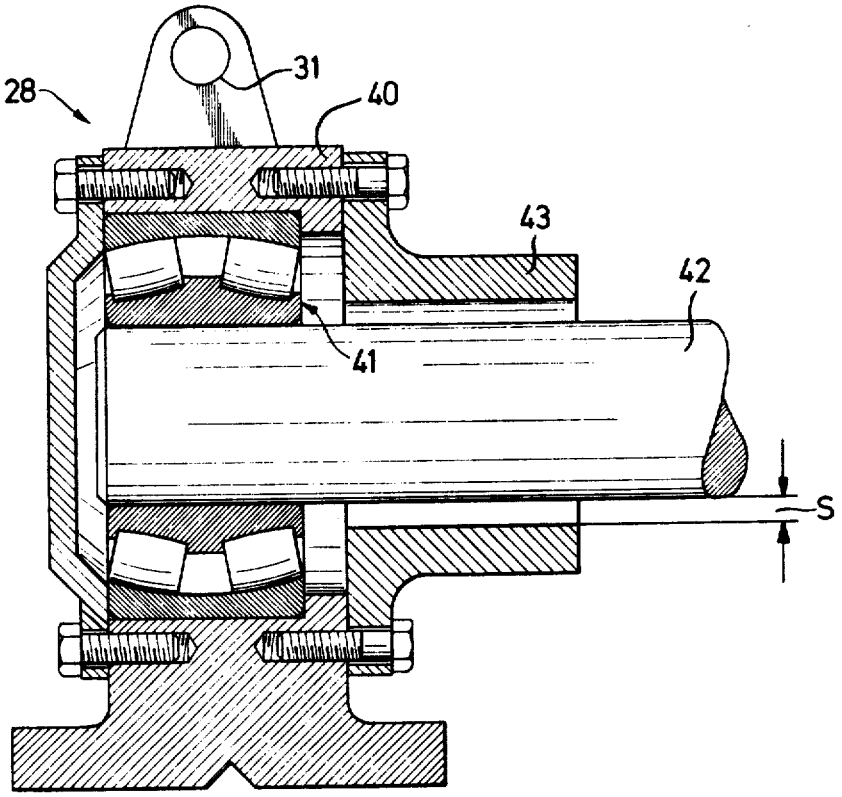
FIG. 3 illustrates a detail of one of the bearings of the pivotal guide roll to an enlarged scale in comparison with FIG. 1.

Referring to FIG. 3, the bearing 28 comprises a casing 40 which carries the eye 31. The casing 40 contains a spherical or rockable roller bearing 41 by means of which a shaft 42 of the pivotal guide roll 7 is mounted. As will be seen from FIG. 3, an abutment ring 43 is secured to the casing 40 and encloses the shaft 42. The clearance S between the abutment ring 43 and the shaft 42 is such that in normal operation the shaft 42 does not touch the abutment ring 43 when the shaft 42 sags. When, on the other hand, the roll 7 is swung out, as shown in FIG. 1, on a change of felt, the abutment ring 43 limits the rocking movement of the bearing 28 with the casing 40 and the roller bearing 41 with respect to the shaft 42, thus avoiding any damage to the roller bearing 41.

The other bearing 33 of the roll 7 may be constructed in the same way as bearing 28. Referring to FIG. 1, a special abutment ring 50 is associated with the bearing 33 and has a screwthreaded rod 51 which is secured by nuts 52 on a baseplate 53 of the support 34 adjacent the bearing 33. The operation of the abutment ring 50 is the same as that of ring 43.

What is claimed is:

1. A web press for a paper machine comprising a plurality of press rolls for pressing of an endless press felt thereagainst;

a plurality of guide rolls disposed below said press rolls to guide the felt in a downwardly directed loop, at least one of said guide rolls being located in the bottom region of the loop and being pivotally mounted about an axis adjacent one end thereof to pivot upwardly from an operative position;

a first bearing journalled on an end of said one guide roll opposite said one end;

a second bearing journalled on said one end;

means for releaseably mounting said first bearing with said one guide roll in said operative position;

a support mounting said second bearing thereon, said support being pivotal about said axis with said axis being horizontally disposed transverse to said one guide roll below said second bearing; and an abutment for supporting said support beneath said second bearing.

2. A web press as set forth in claim 1 which further comprises a lifting means for pivoting said one guide roll from said operative position upwardly, said lifting means including a cable secured at one end to said first bearing.

3. A web press as set forth in claim 1 wherein said first and second bearings are spherical bearings and said one guide roll includes a shaft journalled in said spherical bearings and which further comprises an abutment sleeve secured to at least one of said bearings and disposed about said shaft to limit movement of said one bearing relative to said shaft.

* * * * *